United States Patent [19]

Mertens et al.

[11] 4,361,468

[45] Nov. 30, 1982

[54] FLUE HOUSING FOR A COKE OVEN

[75] Inventors: Alfred Mertens; Franz Schäfer, both of Essen, Fed. Rep. of Germany

[73] Assignee: Didier Engineering GmbH, Fed. Rep. of Germany

[21] Appl. No.: 177,992

[22] Filed: Aug. 15, 1980

[30] Foreign Application Priority Data

Aug. 27, 1979 [DE] Fed. Rep. of Germany ..... 2934532

[51] Int. Cl.[3] ..... C10B 21/10; C10B 21/14; C10B 21/16

[52] U.S. Cl. ..... 202/239; 202/151; 202/270

[58] Field of Search ..... 202/111, 114, 122–127, 202/130, 138–146, 151, 239, 254, 270; 137/601

[56] References Cited

U.S. PATENT DOCUMENTS

| | | | |
|---|---|---|---|
| 3,183,175 | 5/1965 | Brettback et al. | 202/151 |
| 3,630,222 | 12/1971 | Tucker | 202/143 |
| 3,751,342 | 8/1973 | Gidick | 202/151 |
| 4,085,008 | 4/1978 | Kinzler | 202/151 |
| 4,098,289 | 7/1978 | Schlüter et al. | 202/139 |
| 4,102,751 | 7/1978 | Stalherm et al. | 202/151 |

FOREIGN PATENT DOCUMENTS

| | | | |
|---|---|---|---|
| 2460125 | 6/1976 | Fed. Rep. of Germany | 202/151 |
| 687103 | 9/1979 | U.S.S.R. | 202/139 |

*Primary Examiner*—Bradley Garris
*Attorney, Agent, or Firm*—Wood, Herron & Evans

[57] ABSTRACT

A regulating device for the flue housing of a coke oven for alternately opening and closing channels of the flue housing including a rotatable shaft, frames mounted on the shaft, preferably, 90° relative to each other, in alternating sequence along the shaft, peripheral seals about the frames for sealing a channel when the frame is disposed across it. The seals are arcuate in configuration and lie on a circle having its center at the center axis of the shaft. Rotation of the shaft selectively opens and closes alternate channels of the flue housing.

5 Claims, 4 Drawing Figures

FLUE HOUSING FOR A COKE OVEN

BACKGROUND OF THE INVENTION

The invention relates to flue housings of a coke oven with at least one cross-sectional regulating device consisting of frames on which plates are placed, which frames are alternately shut down on flues with the aid of a pull rod.

In prior flue housings of the type involved in this invention, the frames are mounted on parallel shafts which are arranged beside the entrance of the flues. For changeover of the cross-sectional regulation device from air supply to flue gas exhaust, it is necessary first to open one frame. Only then can the other frame be swung across the entrance of the flues, since the frames will otherwise strike one another. Since the changeover is effected with a single pull rod, an expensive coupling is necessary between it and the shafts. With this coupling, for instance, each frame must have individual bearings and operator levers which are attached by means of springs to the shafts and which must be engaged by bolts of the pull rod. One of the two frames is so covered with plates that a uniform heating is obtained in the furnace. On the other frame, the plates are so arranged that in the exhaust a desired flue gas velocity is obtained. Doors are provided on the flue housing for plate placement on the frames. Due to the specific damper positions, it is difficult with the above flue housing to place plates on the frames.

SUMMARY OF THE INVENTION

The problem underlying the invention is to provide a flue housing of the type described whose regulating device does not require any expensive changeover mechanisms.

To this end, the problem is solved in accordance with the present invention by providing frames fastened on a common shaft with the sealing rims of the frames being located on a circle around the shaft, and wherein on the shaft there is a crank arm arranged to which the pull rod is attached. Only one common shaft need be rotated for changeover of the frames. Rotation of the single shaft causes a direct changeover, that is, without expensive coupling devices. The constructional expense necessary for the drive of the regulating device is thus greatly reduced.

Additionally, the present invention makes it possible to easily cover the frame, since the frame sides on which the covering takes place point always to the interior of the sole flue housing which is accessible through a door. Moreover, the invention provides for a tighter frame position across the flues than with the prior damper frames since with these, due to inevitable tolerances, only either one or the other rim is located close to the flues.

Other objects and advantages of the invention will be apparent from the following detailed description of the invention taken with the accompanying drawings.

DETAILED DESCRIPTION OF THE INVENTION

Figure 1:
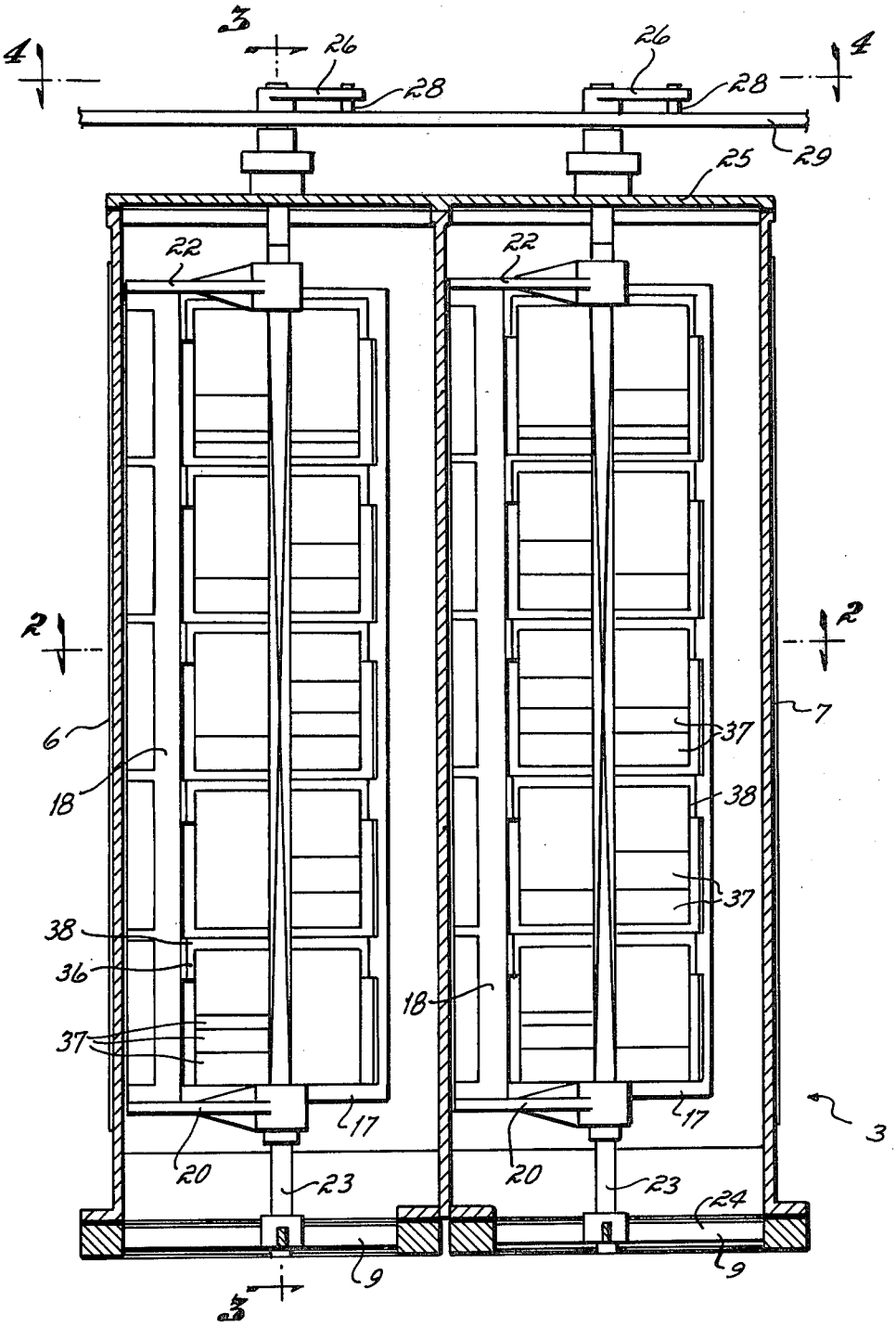
FIG. 1 is a side view of a flue housing with regulating device.
Figure 2:
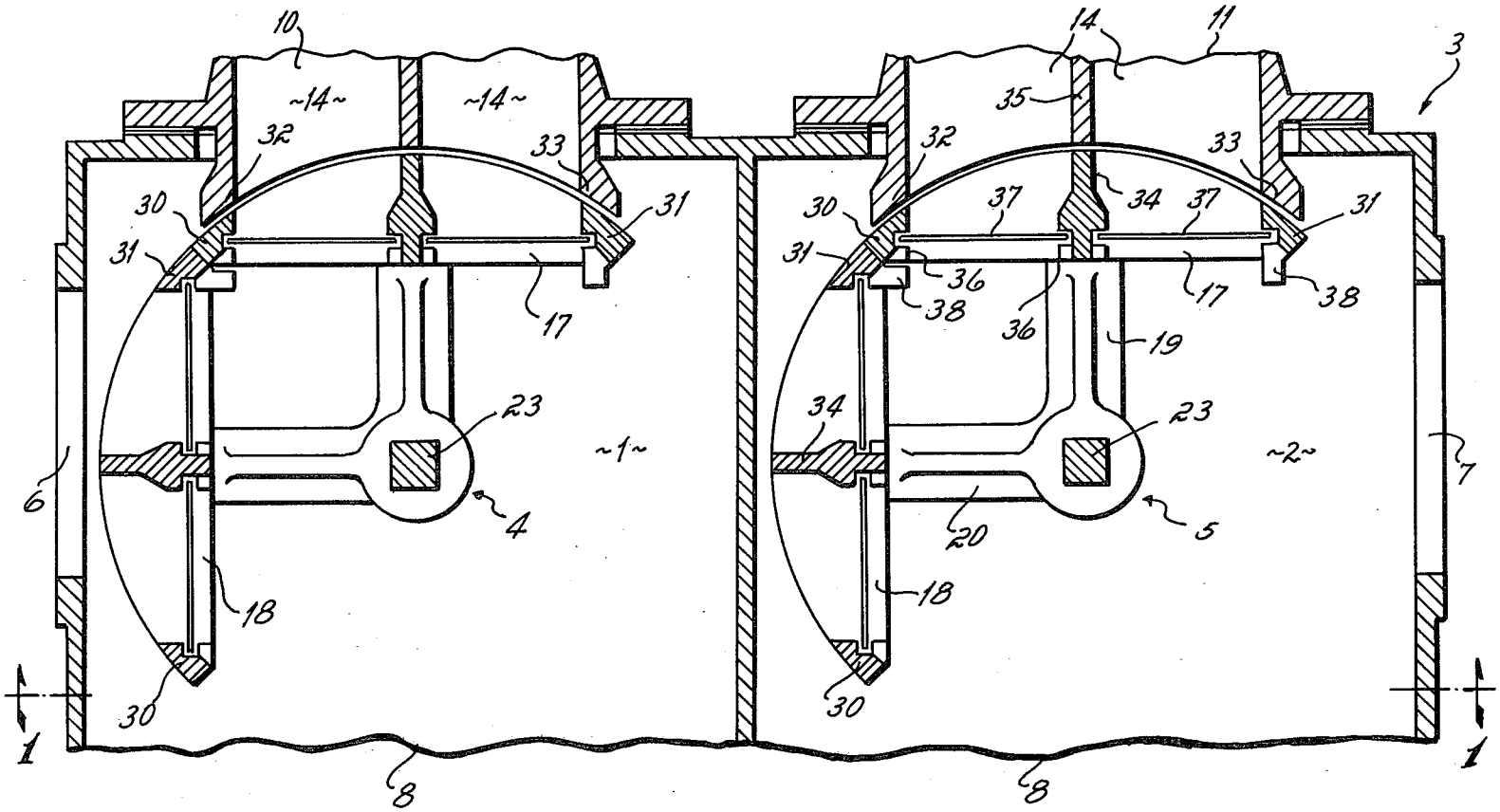
FIG. 2 is a section along line 2—2 of FIG. 1.
Figure 3:
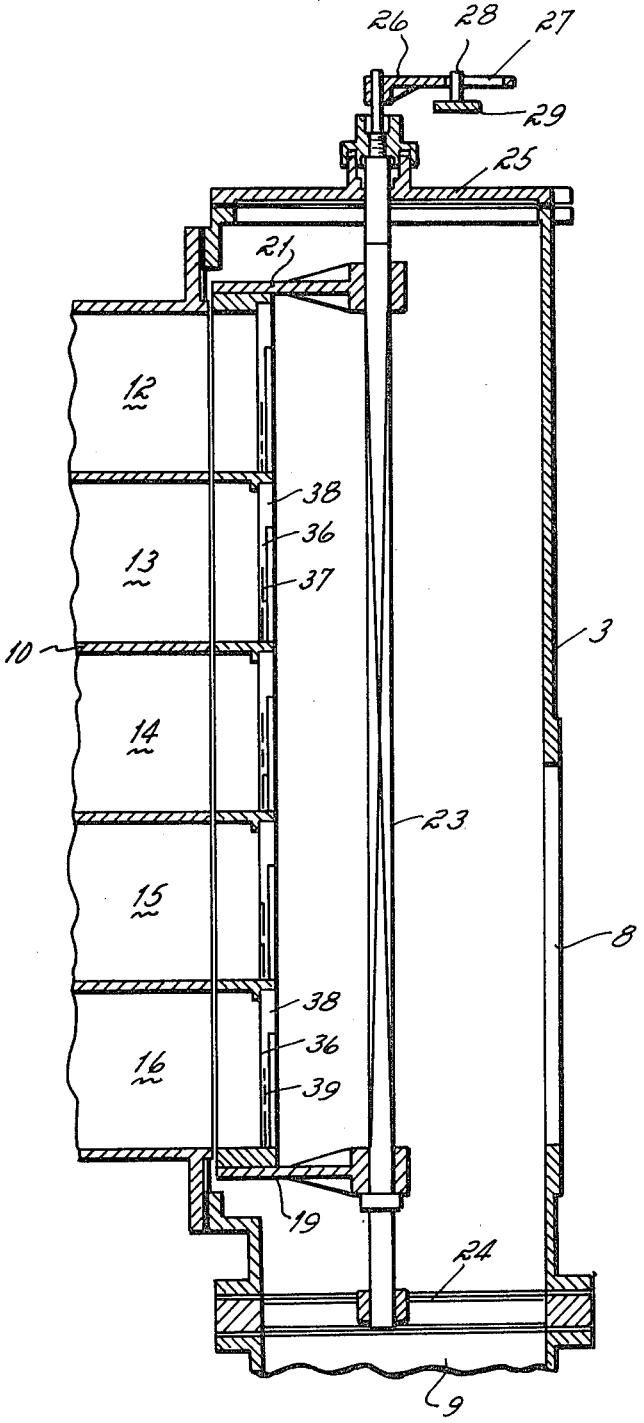
FIG. 3 is a section along line 3—3 of FIG. 1.
Figure 4:
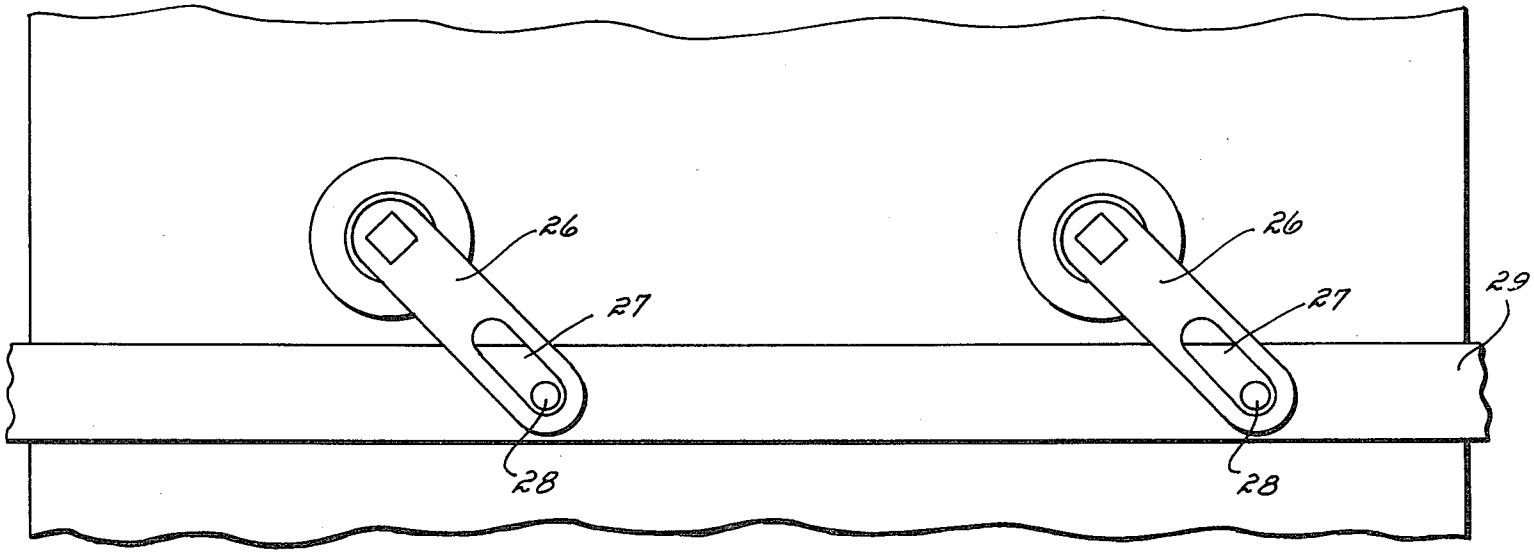
FIG. 4 is a plan view according to line 4—4 of FIG. 1.

Referring to FIGS. 1 and 2, in two adjacent chambers 1 and 2 of a coke oven flue housing 3 are regulating apparatus 4 and 5, respectively. The flue housing 3 has a right and a left opening 6 and 7, respectively. Both openings are sealed by doors not illustrated in any detail.

Each chamber 1 and 2 of the flue housing 3 has an air or a flue gas connection 8 and a lean gas connection 9. Mounted to each chamber is a flue group 10 and 11, respectively. Each flue group includes paired and juxtaposed channels 12 through 16.

The regulating apparatus 4 and 5 comprises two frames 17 and 18 which relative to each other are arranged at an angle of 90°. With the regulating device position as illustrated in the figures, the frames 17 are located across the flue groups 10 and/or 11.

The frames 17 and 18 are by way of lower support arms 19 and 20 and upper support arms 21 and 22 fastened on a shaft 23. The shaft 23 is mounted in rotating fashion, on the one hand, on a support 24 of the lean gas connection 9 and, on the other hand, on a cover 25 of the flue housing 3. On the upper end, outside the flue housing 3, there is a shaft 23 and a crank 26 which on its free end features an oblong hole 27 which is engaged by a bolt 28 mounted on a pull rod 29. The pull rod 29 extends across several sole flue housings.

Rim moldings 30, 31 of the frames 17, 18 form their rim seals. These are arranged on a circle around the shaft 23 (see FIG. 2). In the position of the frame 17 and/or 18 in which it is moved across the flue group, the rim seals 30 and 31 are located with a slide spacing before rims 32 and 33 of the flue walls. Besides, the frame 17 and/or 18 is provided with a sealing web 34 which terminates as well on the circle around the shaft 23 and is flush with a partition 35 of the flue pairs 12 through 16.

Provided on the frame are guideways 36 which in number correspond with the flues. Inserted in the guideways 36 are plates 37 with which the open cross section of each of the flues 12 through 16 can be reduced as desired. For insertion of the plates 37, openings 38 are provided. The plates 37 of frames 17 and 18 in the chamber 2 can be inserted in the position illustrated in the figures simply through the door opening 7, since the insertion openings 38 of the frames 17 and 18 face the inside of the chamber 2.

The same applies to the frames in chamber 1 when they are turned 90° relative to the position illustrated in the figures.

For changeover of the frames 17 and 18 of the two chamber 1 and 2, the pull rod 29 is shifted. This causes a pivoting of the cranks 26 which are positively attached to it so that, consequently, the shafts 23 will rotate. The rotation of the shafts 23 causes the frames 17 to be moved away from the flues while the frames 18 move in front of them. The arrangement of the frames 17 and 18 on the shaft 23 makes it possible to move both frames simultaneously and with one and the same crank.

By turning the two frames 17 and 18 on an arc around the shaft 23 there is as well a uniformly good seal relative to the flues obtained for both frames.

Plates 37, e.g., are so placed on the frames 17, 18 that on a group furnace the frame 17 pertains to the lean gas firing in which alternately lean gas and flue gas is passed through the flues. The frame 18 is in this case assigned to the rich gas firing in which alternately air and flue gas are passed through the flues. On a four-section furnace the plate placement on frame 17 is designed for flue gas, that of the frame 18 for gas and/or air.

We claim:

1. Regulating apparatus for the flue housing of a coke oven comprising a shaft, a pair of frames mounted on said shaft operative to selectively seal said flue housing when disposed thereacross, rim seals on the periphery of said frames, said seals being located on arcs of a circle whose center lies on the axis of said shaft, and means for rotating said shaft to selectively move said frames across said flue housing thereby regulating the opening and closing of said flue housing.

2. The apparatus of claim 1 where the frames are disposed at an angle of 90° relative to each other.

3. The apparatus of claim 1 further comprising a sealing web across said frames and located on said arc of said circle.

4. The apparatus of claim 1 wherein said means for rotating said shaft comprises a crank arm having an oblong opening therein, a pull rod attached to said crank arm by a bolt on said pull rod being captured in said opening.

5. The apparatus of claim 1 wherein said frames are each mounted on said shaft by a support arm fastened at one end on said shaft.

* * * * *